United States Patent [19]

Bechtold

[11] Patent Number: 4,750,302

[45] Date of Patent: Jun. 14, 1988

[54] INSULATED GLASS SKYLIGHT ASSEMBLY

[76] Inventor: Stephen K. Bechtold, 306 Ocean Ave., Northport, N.Y. 11768

[21] Appl. No.: 935,208

[22] Filed: Nov. 26, 1986

[51] Int. Cl.[4] ..... E04B 7/18; E04D 13/03

[52] U.S. Cl. ..... 52/72; 52/200; 52/398; 52/788

[58] Field of Search ..... 52/72, 200, 788, 398

[56] References Cited

U.S. PATENT DOCUMENTS

| | | | |
|---|---|---|---|
| 2,875,710 | 3/1959 | Bechtold . | |
| 3,090,613 | 5/1963 | Bechtold . | |
| 3,280,523 | 10/1966 | Stroud et al. | 52/788 X |
| 3,417,522 | 12/1968 | Kiekhaefer . | |
| 3,417,527 | 12/1968 | Kiekhaefer . | |
| 3,434,250 | 3/1969 | Kiekhaefer . | |
| 4,073,097 | 2/1978 | Jentoft et al. . | |
| 4,348,435 | 9/1982 | Mistrick | 52/788 X |
| 4,388,784 | 6/1983 | Jentoft et al. | 52/200 |
| 4,408,422 | 10/1983 | Bechtold . | |
| 4,441,284 | 4/1984 | Bechtold . | |
| 4,468,899 | 9/1984 | Miller | 52/788 X |

FOREIGN PATENT DOCUMENTS

| | | | |
|---|---|---|---|
| 2056241 | 5/1972 | Fed. Rep. of Germany | 52/200 |
| 2336747 | 2/1975 | Fed. Rep. of Germany | 52/200 |
| 112854 | 5/1966 | Netherlands | 52/200 |
| 2077834 | 12/1981 | United Kingdom | 52/788 |

*Primary Examiner*—Alfred C. Perham
*Attorney, Agent, or Firm*—Hoffmann & Baron

[57] ABSTRACT

An insulated glass skylight assembly is provided that is adapted to be mounted to cover an opening in a roof structure. The assembly includes a box-like liner adapted to be mounted adjacent the edge of an opening in a roof structure around the periphery thereof, to surround the opening and to form a wall extending upward from the roof structure. A swinging window unit is provided which includes an insulated glass insert, an inner supporting frame, and an outer encasing frame. The insulated glass insert is of a predetermined size and shape to substantially conform to the opening in the roof structure, and the inner supporting frame is adapted to engage and seat on the liner and to support the glass insert. The outer supporting frame is adapted to be coupled to the inner supporting frame and capture the glass insert therebetween. The inner and outer frames are located adjacent the wall of the liner and engage the peripheral portion of the glass insert so as to expose a maximum amount of the glass insert overlying the opening in the roof structure, while maintaining minimum exterior dimensions for the skylight assembly. A first sealing system is positioned between the glass insert and the inner and outer frames to provide insulation and prevent a direct contact therebetween. A second sealing system is positioned between the engaging surfaces of the inner supporting frame and the liner so as to seal the engaging surfaces therebetween when the swinging window unit is positioned on the liner. Also, a pivotable interconnection between the swinging window unit and the liner is provided, so as to permit shifting of the swinging window unit between an open and closed position with respect to the liner.

30 Claims, 4 Drawing Sheets

35B
35C
33
37
35D
35A
33
36
15
38
38
39
17
18
16
13
20
25
23
24
26C
30
26B
30
14
26D
28
26A
30
28
27
30
6
8
7
11
29
7
29
11
8
3
10

INSULATED GLASS SKYLIGHT ASSEMBLY

BACKGROUND OF THE INVENTION

1. Field Of The Invention

The present invention relates generally to skylight technology including skylight assemblies having a swinging window unit, a box-like liner, and a flashing frame, operable to open and close while maintaining a weatherproof and leak proof structure, and which can be manufactured at low cost, yet remain dependable and easy to use over a prolonged period of time. But more particularly, the present invention relates to insulated glass skylight assemblies that have superior insulation properties and provide a maximum light transmission area utilizing minimum outer encasing frame dimensions, while inhering features of easy manufacture and assembly, low mass, increased rigidity and enhanced appearance.

2. Setting For The Invention

The art is replete with skylight technology of various types and designs that have been adapted to many environments, for example, roof structures of buildings and vehicles. Certain designs are permanently sealed and others are designed to be opened and closed as desired for ventilation purposes. Skylight assemblies are normally designed to be permanently mounted in a roof structure. They must be versatile and easy to install in a finished roof whether it be as part of initial construction or in an existing roof. Cost is virtually always a factor that is given careful consideration.

Recent successful skylight designs of the type under consideration are disclosed in prior U.S. Pat. Nos. 2,875,710, 3,093,613, 4,408,422 and 4,441,284. A consideration of these four (4) disclosures show the manner in which skylight designs have progressed over the past 20 years. The present invention represents desirable modifications in a similar type of structure.

U.S. Pat. No. 4,441,284 to Bechtold discloses a double dome skylight assembly, having a maximum degree of dome separation, particularly at the edges, in order to create a more uniform insulating condition. Therein, it is believed that a ¾ inch optimal separation should be maintained between the domes throughout the spaced adjacent dome surfaces. This spacing served to avoid potential "cob web" type condensation which forms at the edges of the domes when they are spaced too closely together. In this connection, double dome skylight assemblies and constructions of this sort employ plastic materials to form the domes. However, in many applications, there is a need for glass panels as well.

There has therefore been a desire to provide skylight assemblies having window structures made of glass, while at the same time, obtaining the advantages of the insulative properties of double-dome plastic skylight assemblies. Accordingly, prior art has taught the use of two panes of glass in a skylight assembly, but such constructions have been fraught with problems. One major problem has been with the sealings around the window structures, especially since water has a tendency to collect at the lower end of flat glass structures disposed at inclines. Often, water penetrates through the seals and collects within the swinging window unit. Moreover, the manufacture of such double glass skylight assemblies has been difficult, since it has been the convention to first manufacture a double window structure, and then, to incorporate such window structure into a substantially larger frame of a skylight assembly. In addition to this additional step in the manufacturing process and its resulting cost, this has resulted in minimizing the amount of glass overlying the opening in the roof structure, and yielding skylight assemblies with excessive exterior dimensions. Notably, this has also resulted in additional weight, greater overall size, and increased difficulty in assembly.

Other problems arising a convection with prior art skylight assemblies, include physical distortion of support frames when exposed to torsional forces occasioned by natural elements such as wind.

Another problem that often arises in connection with prior art skylight assemblies, involves the penetration of water past the window seals and the collection thereof within the structural elements of the skylight assembly itself. In temperatures below 0° Celsius, freezing of such collected water can cause serious damage to the structure of the skylight assembly, and in temperatures above freezing, such collected water may penetrate past other seals resulting in water damage to the interior of the house into whose roof structure the prior art skylight assembly is installed.

An even further problem in connection with prior art skylight assemblies, involves rain water striking the outer encasing of the skylight assembly, and dripping onto and moving towards other structural elements thereof rather than flowing away from the skylight assembly, as would be desired.

SUMMARY OF THE INVENTION

With the above background in mind, it is among the primary objects of the present invention to provide an improved skylight assembly for a roof. In particular, the skylight assembly is formed with a swinging double glass window unit shiftable between a position overlying an opening in the roof and a position permitting access to the opening in the roof from the exterior of the structure. The two sheets of glass of the present invention are uniformly spaced for insulative purposes, provided with superior seals, and permit optimal passage of light into the interior of the structure, while utilizing minimum outer encasing frame dimensions.

It is an object of the present invention to provide an insulated glass skylight assembly having an insulated glass insert captured between an inner supporting frame and an outer encasing frame, with a first means for sealing interposed between the outer encasing frame and the insulated glass insert, and between the insulated glass insert and the inner supporting frame, and a second means for sealing interposed between the inner supporting frame and the box-like liner. In this manner, the insulated glass insert is captured between the inner supporting frame and outer encasing frame, and seals effected between engaging surfaces, so as to expose a maximum amount of the glass insert overlying the opening in the roof structure, while maintaining minimum exterior dimensions for the skylight assembly.

It is an even further object of the present invention to provide an insulated glass skylight having a glass insert whose outer panel of glass has been double annealed for strength, and whose inner panel of glass is laminated insulated glass, thereby providing superior insulation properties.

It is an even further object of the present invention to provide an insulated glass skylight assembly having superior insulation properties over prior art skylight assemblies.

It is an even further object of the present invention to provide an insulated glass skylight assembly having an optimal light-transmissive-surface-area to outer-encasing-frame-area ratio, while affording a reduction in overall size and weight, and an improvement in overall appearance of the insulated glass skylight assembly.

It is an additional object of the present invention to provide an insulated glass skylight assembly that overcomes condensation build-up problems in other skylight assemblies.

It is yet an even further object of the present invention to provide an insulated glass skylight assembly with minimum manufacturing, installation, and maintenance cost, in addition to having a simpler method of assembly in comparison to prior art skylight assemblies.

It is a further object of the present invention to provide an insulated glass skylight assembly having a swinging window unit designed to provide resistance against torsional and like forces acting thereon, so to provide the swinging window unit hereof with anti-distortion features.

It is a further object of the present invention to provide an insulated glass skylight assembly having no exposed fasteners of any sort.

It is an even further object of the present invention to provide an insulated skylight assembly having a water escape feature so as to provide a way for entrapped water within the swinging window unit, to escape therefrom.

In summary, from one of its aspects, the present invention embraces an insulated glass skylight assembly adapted to be mounted to cover an opening in a roof structure. In general, the insulated skylight assembly includes a swinging window unit, a box-like frame or liner, and a flashing frame. The box-like liner is adapted to be mounted adjacent the edge of the opening in the roof structure around the periphery, so to surround the opening and to form a wall extending upward from the roof structure. The swinging window unit comprises an insulated glass insert of a predetermined size and shape to substantially conform to the opening in the roof structure; an inner supporting frame; an outer encasing frame adapted to be coupled to said inner supporting frame and capture the glass insert therebetween; a first means for sealing, positioned between the glass insert and the inner and outer frames to provide insulation and prevent a direct contact therebetween; and a second sealing means positioned between the engaging surfaces of the inner supporting frame and the liner so as to seal the engaging surfaces therebetween when the swinging window is lowered onto the liner. In order to permit shifting of the swinging window unit with respect to the liner between a closed position overlying the opening in the roof structure and in sealing engagement therewith, and an open position permitting access to the opening from the exterior of the roof structure, a means for pivotably interconnecting the swinging window unit to the liner is provided.

The present invention accordingly comprises the apparatus and methods, together with their parts, components, steps, and interrelationships, which are exemplified in the present disclosure, the scope of which will be indicated by the appended claims.

Other and further objects will be explained hereinafter and will be more particularly delineated in the appended claims, and other objects of the present invention will, in part, be obvious to one with ordinary skill in the art to which the present invention pertains, and will, in part, appear obvious hereinafter.

BRIEF DESCRIPTION OF THE DRAWINGS

For a fuller understanding of the objects of the present invention, reference is made to the following detailed description of the preferred embodiment, which is to be taken in connection with the accompanying drawings, wherein.

DETAILED DESCRIPTION OF PREFERRED EMBODIMENT

Figure 1:
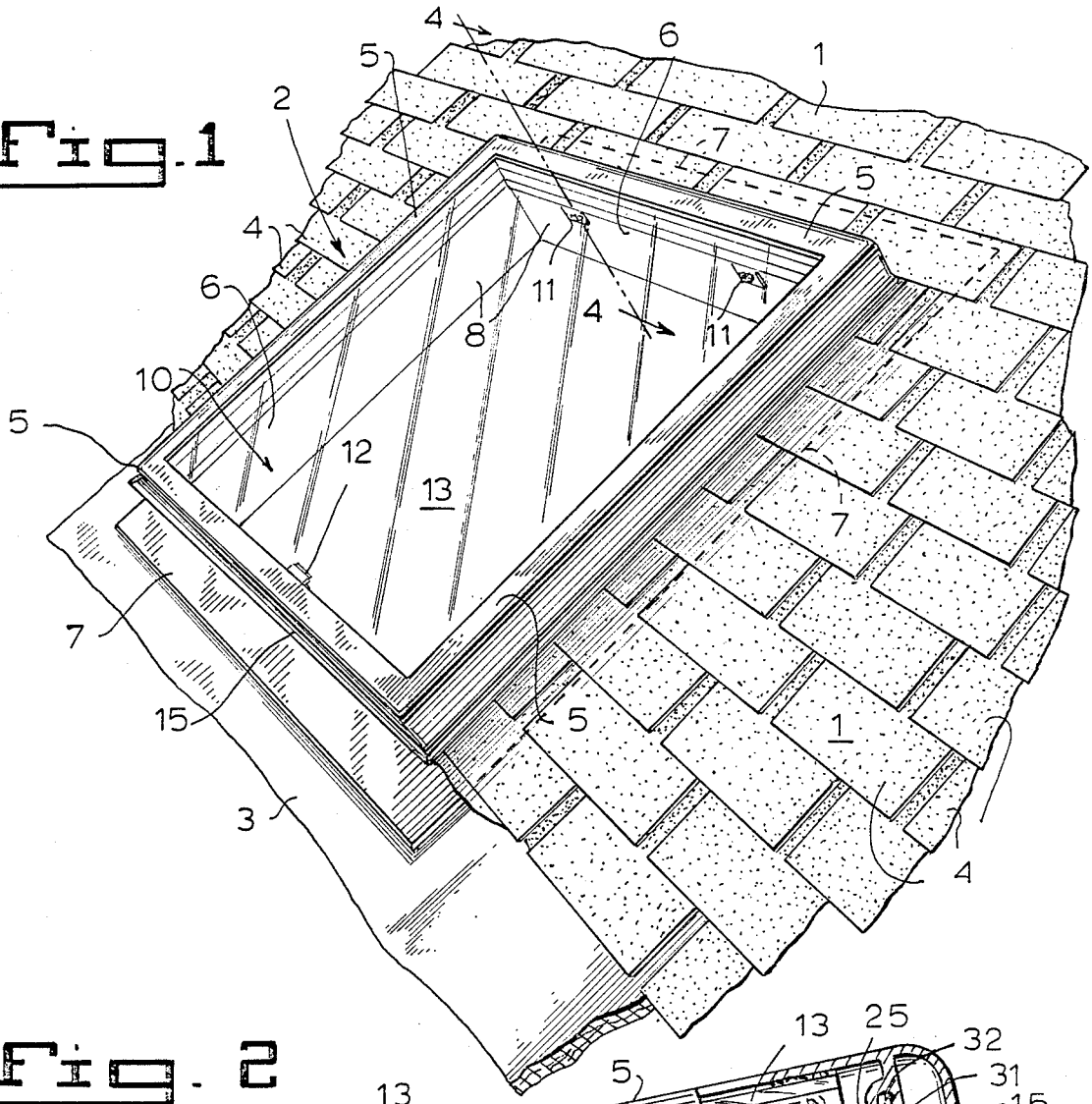
FIG. 1 is a plan view of the insulated glass skylight assembly hereof mounted on a roof structure, shown with its swinging window unit in a closed position overlying an opening in the roof structure and in sealing engagement with the liner.

It is now in order to describe in a best mode embodiment, the details of the insulated glass skylight assembly hereof.

Referring to the drawings, particularly FIGS. 1, 2, 4 and 6, a roof structure 1 is shown with an insulated glass skylight assembly 2 of the present invention mounted thereon. Roof structure 1 includes conventional roof sheathing 3 covered by an overlay of conventional shingles 4.

Referring to FIGS. 1, 2, 4 and 6, the insulated glass skylight assembly 2 of the present invention is shown comprising a swinging window unit 5, a box-like frame or liner 6, and a flashing frame 7.

The box-like liner 6 includes four adjoining side walls 8 arranged in a rectangular or square configuration to form an aperture therebetween. The walls 8 can be formed of conventional material such as wood, for example plywood, or metal.

The flashing frame 7 is mounted on the roof surface in a conventional manner between the sheathing 3 and the shingles 4, and has a portion 9 engaging walls 8 by extending up the walls and over the upper edge, and is affixed in a conventional manner in that position. The flashing is arranged to surround an opening 10 in the roof and the liner 6 also surrounds the periphery of opening 10 in the roof 1 so that the aperture in the liner is aligned with the opening 10 in the roof structure 1. The box-like liner 6 is adapted to be mounted adjacent the edge of the opening 10 in the roof structure 1 around the periphery thereof, so to surround the opening 10 and to form a wall extending upward from the roof structure 1. A suitable screen can be conventionally mounted on the interior of the walls 8 to overlie opening 10 in the roof structure and extend across aperture in the box-like liner 6.

The swinging window unit 5 is mounted on one of the walls 8 of the box-like liner 6 by the use of a means for pivotably interconnecting the swinging window unit 5 and the liner 6, e.g., a pair of suitable hinges 11, described and explained in greater detail in a later section hereof. In a conventional manner, the side of the swinging window unit 5 opposite the side connected by hinges 11 is provided with a suitable operating unit 12 for opening and closing of the swinging window unit 5 with respect to the box-like liner 6 as it rotates about hinges 11. The operating unit can be a well known type of handle, pole, or motorized unit.

Figure 2:
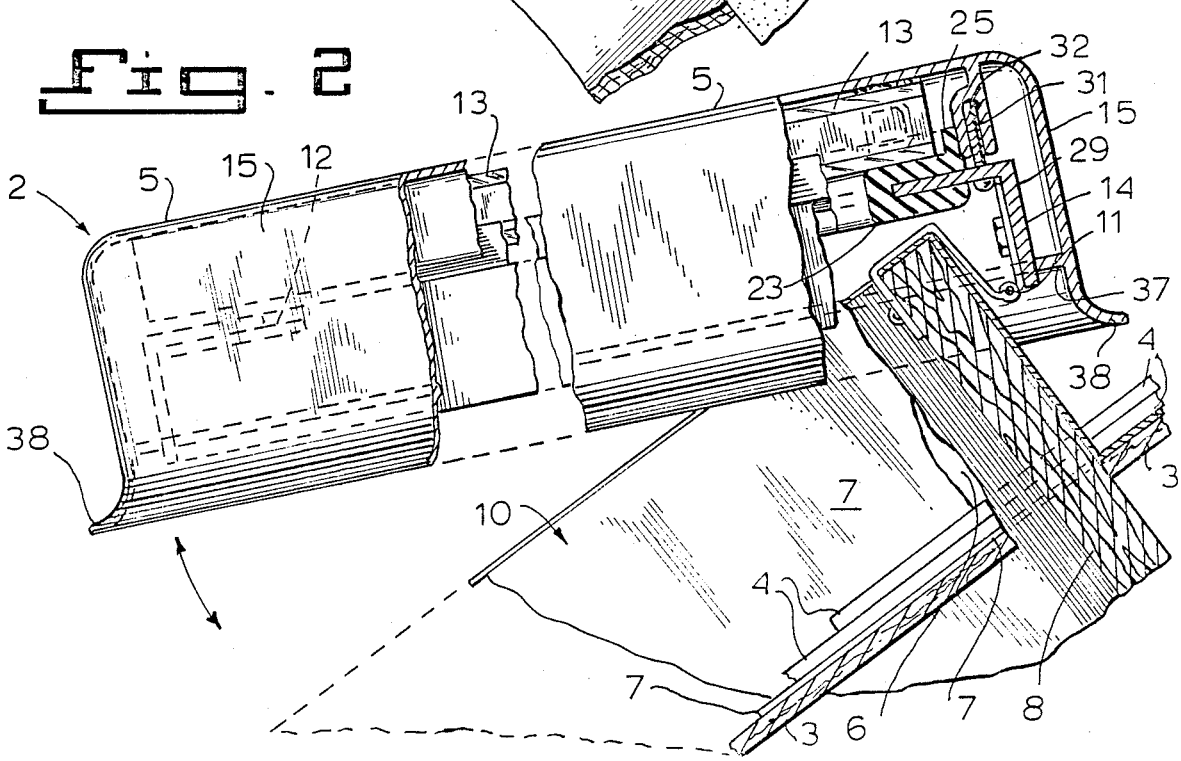
FIG. 2 is a partial cut-away side view of the swinging window unit hereof which is hinged to the liner extending upward from and along the roof structure, and shown in an open position permitting access to the opening therein from the exterior of the roof structure.
Figure 3:
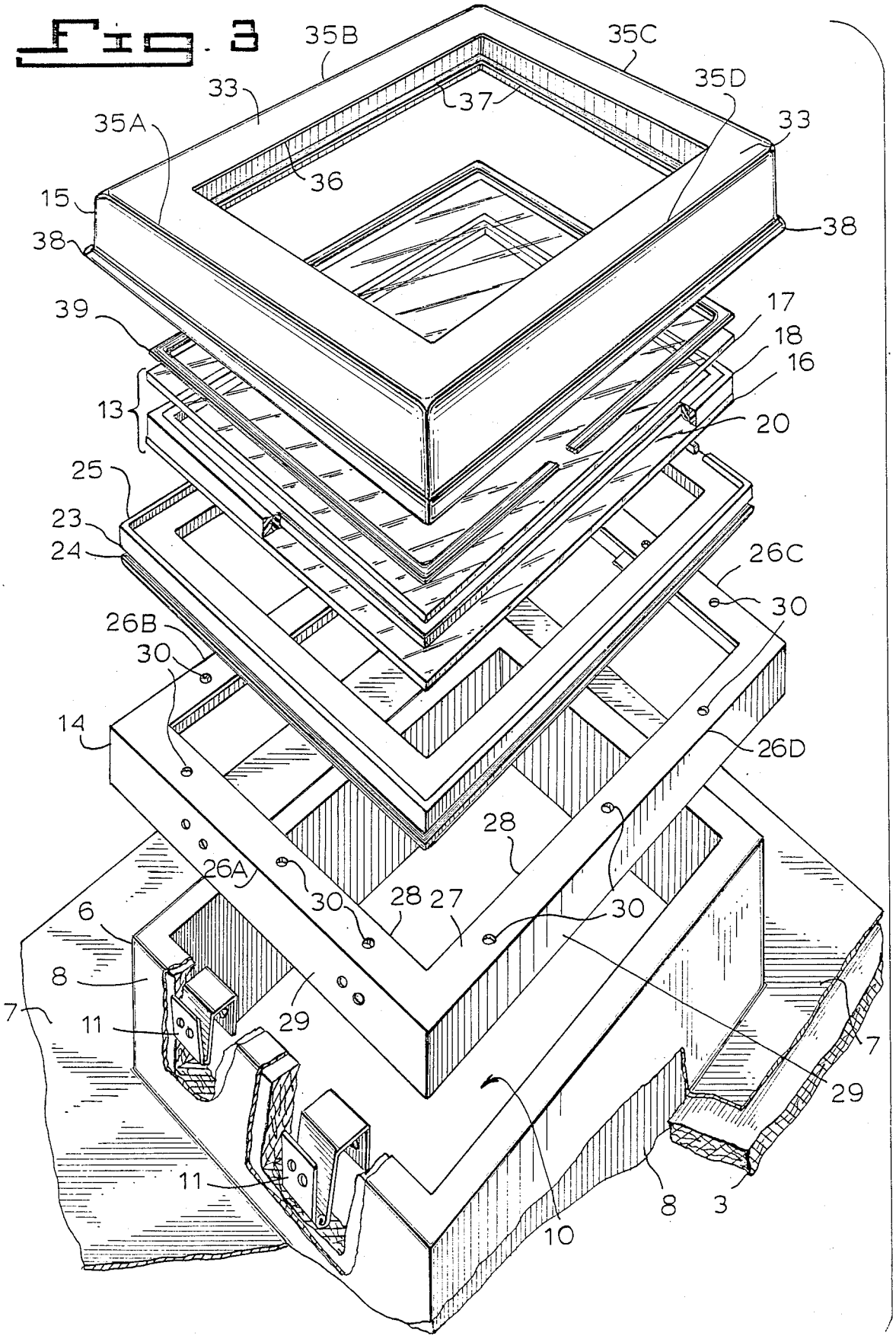
FIG. 3 is an exploded perspective view of the insulated glass skylight assembly hereof showing the outer encasing frame positioned above an exploded partially cut-away view of the glass insert that is positioned above the inner supporting frame, which is positioned above the box-like liner.
Figure 4:
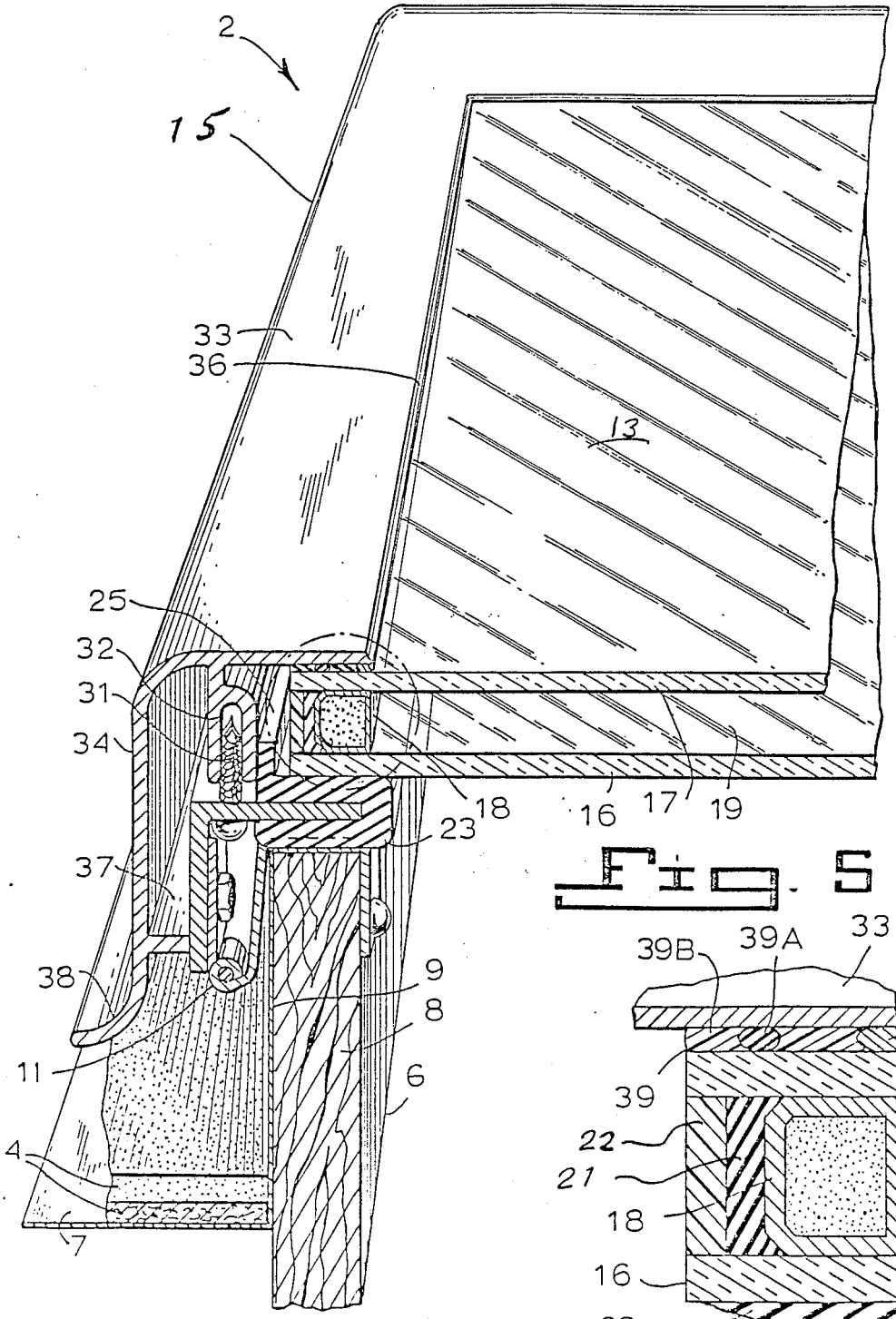
FIG. 4 is a longitudinal cross-sectional view of the insulated glass skylight assembly hereof with the swinging window unit thereof in a closed position, showing the insulated glass insert, the inner supporting frame, and the outer encasing frame adapted to be coupled to the inner supporting frame and capture the glass insert therebetween.

Referring to FIGS. 2, 3 and 4, the swinging window unit hereof is shown comprising, in general, an insulated glass insert 13, an inner supporting frame 14, an outer encasing frame 15, a first means for sealing, and a second means for sealing. The insulated glass insert 13 is of a predetermined size and shape to substantially conform to the opening 10 in the roof structure 1. The inner supporting frame 14 is adapted to engage and seat on the box-like liner 6 and to support the glass insert 13. The outer encasing frame 15 is adapted to be coupled to the inner supporting frame 14 and capture the glass insert 13 therebetween, with the inner and outer frames 14 and 15 respectively, being located adjacent the wall 8 of the box-like liner 6 and engaging the peripheral portion of the glass insert 13. This arrangement results in exposing a maximum amount of the glass insert 13 overlying the opening 10 in the roof structure 1 while maintaining minimum exterior dimensions for the skylight assembly 2. The first means for sealing is positioned between the glass insert 13 and the inner 14 and outer frames 15 in order to provide insulation and prevent a direct contact therebetween. The second means for sealing is positioned between the engaging surfaces of the inner supporting frame 14 and the liner 6 so as to seal the engaging surfaces therebetween when the swinging window unit 5 is positioned on the liner 6.

Referring to FIGS. 3 and 4, there is shown in greater detail, the insulated glass insert 13 hereof comprising, in general, an inner panel 16, an outer panel 17 and a panel spacer frame 18. In the preferred embodiment, the inner panel 16 is a laminated glass construction comprising two layers of clear glass bonded together by a layer of plastic film. The outer panel 17 is tempered glass. The panel spacer frame 18 has a hollow substantially rectangular cross-section with a preferred height of about 7/16 of an inch. The panel spacer frame 18 is interposed between the inner panel 16 and the outer panel 17 to form an air-filled cavity 19 therebetween (providing a dead air space), and is positioned equidistant from the peripheries of the panels 16 and 17, so to thereby form about the periphery of the glass insert 13, an open channel-like cavity 10 between the intersection of the outer panel 17, inner panel 17, and the panel spacer frame 18, as shown in FIG. 3 in particular In order to prevent water and moisture from entering the air-filled cavity 19 formed between the inner panel 16 and outer panel 17, the hollow substantially rectangular panel spacer frame 18 is filled with a moisture retaining substance, such as a desiccant. In order to maximize the shading coefficient and thereby retard fading of interior furnishings, a low emissivity coating is applied to the inside surface of the outer panel 17 which makes direct contact with the panel spacer frame 18 and which is one surface of the open channel-like cavity 20. To properly bond the inner panel 16, outer panel 17, and the panel spacer frame 18 together, and to seal off the air-filled cavity 19 from outside water and moisture, a two part sealing system is employed. Specifically, the open channel-like cavity 20 is filled with an adhesive material 21, e.g., a butyl rubber, for bonding the inner panel 16, the outer panel 17 and the panel spacer frame 18 together, and then a sealing material 22, e.g, water-impervious silicone, is applied upon the adhesive material 21 so as to prevent water and other natural elements from establishing contact with the adhesive material 21 which does not, by its nature, withstand exposure to moisture as does the sealing material 22. Once completely assembled in accordance with the discussion provided hereinabove, the insulated glass insert 13 is in the form of a unitary component ready for installation within the swinging window unit 5 as will be discussed hereinbelow.

Referring now to FIGS. 3 and 4, greater focus will be given to the other components of the swinging window unit 5, and the manner in which each is installed with respect to the other. As shown in FIGS. 3 and 4, the inner supporting frame 14, is slightly greater in size and dimensions than the box-like liner 6, and is adapted to engage and seat on the liner 6 and to support the glass insert 13 in such a way, that direct contact between the glass insert 13 and the inner supporting frame 14 is prevented and insulation therebetween is provided. Also, there is to be provided a seal between the engaging surfaces of the inner supporting frame 14 and the box-like liner 8 when the swinging window unit 2 is positioned on the liner 6. The way in which superior sealing is achieved between the engaging surfaces identified hereinabove, is by using a gasket 23 whose outer side has a slot 24 formed therein, that is adapted to receive and seal the peripheral edge of the inner supporting frame 14. The gasket 23 has an outer orthogonally-projecting edge 25 in position to cooperate in properly seating the glass insert 13 and to prevent direct contact of the glass insert 13 with the inner supporting frame 14 and the outer encasing frame 15. As indicated hereinbefore, the gasket or extrusion 23, preferably made of conventional sealing material such as thermoplastic or rubber, serves to not only seal the peripheral edges of the swinging window unit 5 (i.e., the engaging surfaces of the inner supporting frame and the liner), but also to seal the interface between the inner panel 16 of the glass insert 13 and the inner supporting frame 14.

Figure 5:
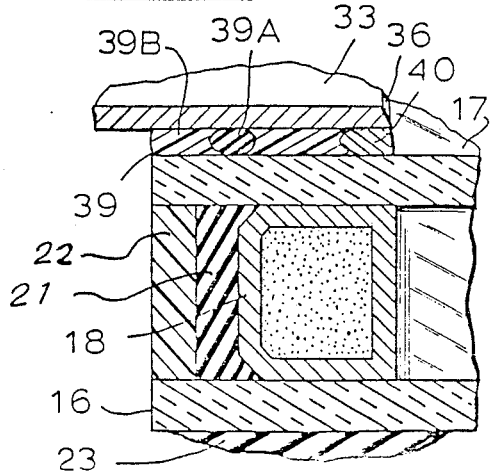
FIG. 5 is an enlarged view of the first means for sealing hereof, contained within the circle of FIG. 4, showing the first means for sealing positioned between the glass insert and the outer encasing frame to provide insulation and prevent a direct contact therebetween.

Referring to FIGS. 2, 3 and 5, the inner supporting frame 14 is shown to be formed of four elongated L-shaped members 26A, 26B, 26C and 26D, joined and secured together at mitered corners in a conventional manner, so as to produce a rectangular configuration as shown in FIG. 3 in particular. As shown more clearly in FIGS. 3 and 4, the L-shaped members of the inner supporting frame 14 provide a flat top surface 27 with an inner peripheral edge 28 so that the slot 24 formed in the gasket 23 may receive the inner peripheral edge 28 of the inner supporting frame 14, thereby sealing the peripheral edge 28 thereof. Also, as indicated in FIGS. 2, 3 and 4, the L-shaped members 26A through 26D of the inner supporting frame 14, have a flat side surface 29 which are in a side-by-side parallel relationship with walls 8 when the swinging window unit 2 is lowered onto the box-like liner 6. In order that the inner supporting frame 14 may be fastened to the outer encasing frame 15 and thereby capture the glass insert 13 therebetween, a plurality of holes 30 are formed in the top surface 27 of the inner supporting frame, and wherethrough a plurality of screws 31 are inserted and grip into the inner side walls of a channel 32 which projects orthogonally from the inside of the outer encasing frame 15. The channel 32 will be described in greater detail hereinbelow.

Referring now to FIGS. 2, 3 and 4, focus will now be given to the outer encasing frame 15 and its novel features. In the preferred embodiment, the outer encasing frame 15 is formed of four elongated substantially L-shaped members 35A, 35B, 35C and 35D, joined and secured together at mitered corners in a conventional manner, so as to produce a rectangular configuration as shown in FIG. 3 which is only slightly larger in overall dimensions as to fit over the inner supporting frame 14. As shown more clearly in FIGS. 2 and 4, the substantially L-shaped members of the outer encasing frame 15 hereof provide a flat top surface 33 with an inner peripheral edge 36 which lies directly underneath the inside edge of the panel spacer frame 18 of the glass insert 13, when the outer encasing frame 15 is engaged to receive the inner supporting frame 14 and capture the glass insert 13 therebetween, in order to expose a maximum amount of the glass insert overlying the opening 10 in the roof structure, while maintaining minimum exterior dimensions for the skylight assembly.

Projecting orthogonally from the underside of the top face 33 of the outer encasing frame 15 is the channel 32 which extends longitudinally along the elongated substantially L-shaped members 35A through 35D of the outer encasing frame 15. The channel 32 is disposed thereon as to be positioned behind the glass insert, and to abut against the outer orthoganally-projecting edge 25 of the gasket 23 engaged with the inner supporting frame 14 when the outer encasing frame 15 is engaged therewith, with the glass insert 13 captured therebetween. When the plurality of screws 31 are inserted into the orthoganally-projecting channel 32, each screw 31 bites into the inner side walls thereof and securely fastens the inner supporting frame 14 and outer encasing frame together.

Regarding the feature of improved structural integrity of the insulated glass skylight assembly 2 hereof, and its capacity to shed water away from itself, reference is now made to FIGS. 2, 3 and 5, wherein there is shown an inner flange 37 formed on the inside of the side face 34 of the outer encasing frame 15. The inner flange 37 projects orthogonally from the side face 34 and is disposed adjacent to the inner supporting frame 14 and is in position to abut thereagainst, so as to provide resistance against torsional and like forces acting upon the swinging window unit 5. Moreover, the outer encasing frame 15 has an outwardly extending arcuate-shaped free edge 38 about the periphery edge of the side face 34 of the outer encasing frame 15, so as to divert water and other natural elements away from the swinging window unit 5 and to strengthen the outer encasing frame 15 against torsional and like forces imposed thereon.

Figure 6:
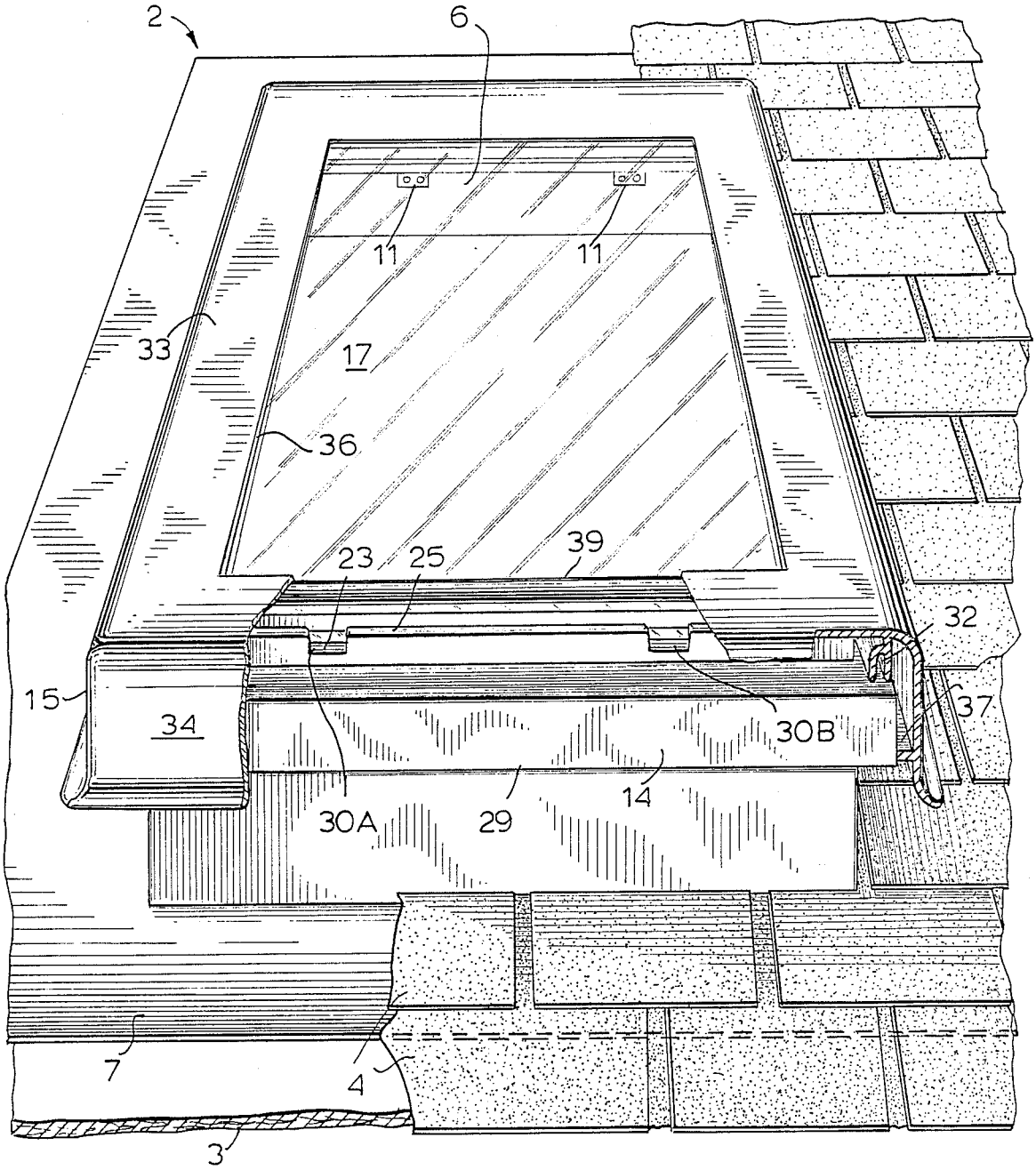
FIG. 6 is a partially cut-away longitudinal view of the insulated glass skylight assembly hereof, with the swinging window unit thereof in a closed position overlying an opening in the roof structure and in sealing engagement with the liner, showing a pair of spaced apart apertures formed in the outer orthogonally-projecting edge of the gasket hereof, so to provide a means for escape for entrapped water from the swinging window unit.

Referring to FIG. 6, a partially cut-away longitudinal view of the insulated glass skylight 2 hereof is shown in a closed position mounted on the roof structure which is disposed at an incline. Specifically, behind the cut-away section of the outer encasing frame 15, the gasket 23 is positioned on the inner peripheral edge 25 of the inner supporting frame 14, with a pair of apertures 30A and 30B formed into the outer orthogonally-projecting edge 25 of the gasket 23 as to provide a means for escaping entrapped water from the inside of the swinging window unit 5. Notably, the apertures 30A and 30B to be most effective in achieving their function, should be located at a side of the swinging window unit 5 wheretowards rain water and natural elements flow in response to gravitational forces, when the swinging window unit 5 is positioned on the liner 6. Alternatively, the positioning of the apertures 30A and 30B may be located elsewhere about the swinging window unit 5, for purposes of escaping any water buildup that may occur about the outside of glass insert 13 as a result of condensation processes.

Attention will now be given to the means for sealing between the glass insert 13 and the outer encasing frame 15, which shall serve to provide insulation and prevent a direct contact therebetween. Referring to FIGS. 3, 4 and 5 in particular, the means for sealing between the glass insert 13 and the outer encasing frame 15 includes a sealing system comprising a strip of sealing material 39 disposed along the perimeter of the glass insert 13, and a strip of caulking 40 disposed on the glass insert 13 adjacent to the strip of sealing material 39 on the side nearest to the center of the glass insert 13. In the preferred embodiment, the strip of sealing material 39 is a pre-shimmed butyl tape strip comprising a substantially non-deformable plastic or like core 39A which is centrally embodied within a strip of butyl rubber 39B. The purpose of the non-deformable core 39A is to prevent excessive extrusion of butyl rubber 39B and the strip of caulking 40 when the outer encasing frame 15 is placed upon the glass insert 13 and securely fastened to the inner supporting frame 14. The strip of caulking 40 is made of a water-impervious urethane rubber. When the sealant system is properly interposed between the outer encasing frame 15 and the glass insert 13, as described hereinabove, superior insulation therebetween will be provided, and direct contact therebetween will be prevented. Any water or moisture that may so happen to permeate through the sealant system hereof or develop on or about the glass insert 13 by the process of condensation, will be relieved through the apertures 39A and 39B, to the outside of the swinging window unit 5.

In summary, then, with (i) the sealant system comprising the strip 39 and the strip 40 in position on the perimeter of the outer panel 17 of the glass insert 13, and (ii) the gasket 23 engaged with the inner supporting frame 14, and (iii) the glass insert 13 seated atop the gasket 23, with (iv) the outer encasing frame 15 secured to the inner supporting frame 14, the glass insert 13 is effectively captured therebetween so as to expose a maximum amount of the glass insert 13 overlying the opening 10 in the roof structure 1, while (a) maintaining minimum exterior dimensions for the skylight assembly 2, (b) establishing superior seals to air, water and moisture at points and surfaces of interface discussed hereinabove, (c) exposing no fasteners of any sort, and (d) achieving the other aforementioned objects of the present invention.

Regarding the means for pivotably interconnecting the swinging window unit 5 to the liner 6, reference is now made to FIGS. 2, 3 and 5. Illustrated therein, is the pair of hinges 11 showing one strap thereof bolted to the flat side face 29 of the inner supporting frame 14, and the other strap thereof bent as to conform to the peripheral surfaces of one of the walls 8 of the box-like liner 6, and bolted thereto. In this manner, the engaging surfaces between the swinging window unit 5 and the liner 6 will be effectively sealed when the swinging window unit is lowered thereonto, as the gasket 23 is interposed therebetween.

At this juncture, a few remarks with respect to installation of the insulated glass skylight assembly 2 hereof will be appropriate. In use, the roof structure 1 is prepared in a conventional manner by forming the opening 10 in the roof surface and preparing the sheathing 3 and shingles 4 for receipt of the insulated glass skylight assembly 2 hereof. In addition, a flashing frame 7 which is preferably made of copper, is mounted to the roof and surrounds the opening 10 therein and the aperture in the liner 6. The swinging window unit 5 can be opened and closed as desired by using the operating unit 12. A screen will protect the opening 10 in the roof structure 1 when the swinging window unit 5 is shifted to the open position.

Further modifications of the present invention herein disclosed, will occur to persons skilled in the art to which the present invention pertains, and all such modification are deemed to be within the scope and spirit of the present invention defined by the appended claims.

What is claimed is:

1. An insulated glass skylight assembly adapted to be mounted to cover an opening in a roof structure, comprising:

a box-like liner adapted to be mounted adjacent the edge of an opening in a roof structure around the periphery thereof, to surround said opening and to form a wall extending upward from said roof structure; and a swinging window unit including, an insulated glass insert of a predetermined size and shape to substantially conform to said opening in said roof structure;

an inner supporting frame adapted to engage and seat on said liner and to support said glass insert;

an outer encasing frame adapted to be coupled to said inner supporting frame and capture said glass insert therebetween, said inner and outer frames being located adjacent said wall of said liner and engaging the peripheral portion of said glass insert so as to expose a maximum amount of said glass insert overlying the opening in said roof structure while maintaining minimum exterior dimensions for said skylight assembly;

a means for sealing positioned between said glass insert and said outer frame to provide insulation and prevent a direct contact therebetween;

a unitary sealing means positioned between the engaging surfaces of said inner supporting frame and said liner and between the engaging surfaces of said glass insert and said inner supporting frame so as to seal said engaging surfaces therebetween when said swinging window unit is positioned on said liner; and means for pivotably interconnecting said swinging window unit to said liner so as to permit shifting of said swinging window unit with respect to said liner between a closed position overlying said opening in said roof structure and in sealing engagement therewith, and an open position permitting access to said opening from the exterior of said roof structure.

2. An insulated glass skylight assembly according to claim 1, wherein said means for sealing includes a sealant system including a strip of sealing material disposed along the perimeter of said glass insert, and a strip of caulking disposed on said glass inset adjacent to said strip of sealing material on the side nearest to the center of said glass insert, said sealant system interposed between said outer encasing frame and said glass inset.

3. An insulated glass skylight assembly according to claim 2, wherein said strip of sealing material is a preshimmed butyl tape strip, and said strip of caulking is made of a water-impervious urethane rubber.

4. An insulated glass skylight assembly according to claim 1, wherein said outer encasing frame has an inner flange formed on the inside of the side faces thereof disposed below said insulated glass insert, projecting orthogonally therefrom and disposed adjacent to the side faces of said inner supporting frame, in postion to abut thereagainst to provide resistance against forces acting upon said swinging window unit.

5. An insulated glass skylight assembly according to claim 1, wherein said outer encasing frame has a outwardly extending free edge about its periphery, so as to divert water and other natural elements away from said swinging window unit and to strengthen said outer encasing frame against forces imposed thereon.

6. An insulated glass skylight assembly according to claim 1, wherein flashing means is mounted in the area of joinder between said liner and said roof structure.

7. An insulated glass skylight assembly according to claim 1, wherein said insulated glass insert comprises;

an inner panel made of laminated glass;

an outer panel made of tempered glass; and a panel spacer frame having a hollow substantially rectangular cross-section, said panel spacer frame interposed between said inner panel and said outer panel.

8. An insulated glass skylight assembly according to claim 7, wherein said panel spacer frame is interposed between said inner panel and said outer panel and positioned equidistant from the peripheries of said panels, thereby forming about the periphery of said glass insert, an open channel-like cavity between the intersection thereof, said open channel-like cavity being filled with an adhesive material for bonding said inner panel, said outer panel, and said panel spacer frame securely together, and a sealing material applied upon said adhesive material so as to prevent water and other natural elements from establishing contact with said adhesive material.

9. An insulated glass skylight assembly according to claim 8, wherein said adhesive material is a butyl rubber, and said sealing material is a water-impervious silicone.

10. A insulated glass skylight assembly according to claim 1, wherein said swinging window unit is rectangular in configuration.

11. An insulated glass skylight assembly according to claim 1, wherein said swinging window unit is square in configuration.

12. An insulated glass skylight assembly adapted to be mounted to cover an opening in a roof structure, comprising:

a box-like liner adapted to be mounted adjacent the edge of an opening in a roof structure areound the periphery thereof, to surround said opening and to form a wall extending upward from said roof structure; and a swinging window unit including, an insulated glass insert of a predetermined size and shape to substantially conform to said opening in said roof structure;

an inner supporting frame adapted to engage and seat on said liner and to support said glass insert;

an outer encasing frame adapted to be coupled to said inner supporting frame and capture said glass insert therebetween, said inner and outer frames being located adjacent said wall of said liner and engaging the peripheral portion of said glass insert so as to expose a maximum amount of said glass insert overlying the opening in said roof structure while maintaining minimum exterior dimensions for said skylight assembly;

a first means for sealing positioned between said glass insert and said inner and outer frames to provide insulation and prevent a direct contact therebetween;

a second means for sealing positioned between the engaging surfaces of said inner supporting frame and said liner so as to seal said engaging surfaces therebetween when said swinging window unit is positioned on said liner; and means for pivotably interconnecting said swinging window unit to said liner so as to permit shifting of said swinging window unit with respect to said liner between a closed position overlying said opening in said roof structure, said first means for sealing including a gasket interposed between said glass insert and said inner supporting frame, and a sealant system including a strip of sealing material disposed along the primeter of said glass insert and a strip of caulking disposed on said glass insert adjacent to said strip of sealing material on the side nearest to the center of said glass insert, said sealant system interposed between said outer encasing frame and said glass insert, said gasket has having a slot formed therein adapted to receive and seal the peripheral edge of said inner supporting frame and has having an outer orthogonally-projecting edge in position to cooperate in properly seating said glass insert and to prevent direct contact of said glass insert with said inner supporting frame and said outer encasing frame.

13. An insulated skylight assembly according to claim 12, wherein said outer orthogonally-projecting edge of said gasket has at least one aperture formed therein, so as to provide a means for escaping entrapped water from said swinging window unit.

14. An insulated skylight assembly according to claim 13, wherein said aperture formed in said outer orthogonallly projecting edge is located at a side of said swinging window unit wheretowards rain water and natural elements flow in response to gravitational forces when said swinging window unit is positioned on said liner.

15. A window unit adapted to be mounted on a liner of a skylight assembly, to cover an opening in a roof structure, comprising:

an insulated glass insert of a predetermined size and shape to substantially conform to an opening in a roof structure;

an inner supporting frame adapted to engage and seat on a liner and to support said glass insert;

an outer encasing frame adapted to be coupled to said inner supporting frame and capture said glass insert therebetween, said inner supporting frame and said outer encasing frame being located adjacent said wall of said liner and engaging the peripheral portion of said glass insert so as to expose a maximum amount of said glass insert overlying the opening in said roof structure while maintaining minimum exterior dimensions for said window unit;

a means for sealing positioned between said glass insert and said outer frame to provide insulation and prevent direct contact therebetween; and a unitary sealing means positioned between the engaging surfaces of said inner supporting frame and said liner and between the engaging surfaces of said glass insert and said inner supporting frame so as to seal engaging surfaces therebetween when said window unit is positioned on said liner.

16. A window unit according to claim 15, wherein said means for sealing includes a sealant system including a strip of sealing material disposed along the perimeter of said glass insert, and a strip of caulking disposed on said glass insert adjacent to said strip of sealing material, on the side thereof nearest to the center of said glass insert, said sealant system interposed between said outer encasing frame and said insulted glass insert.

17. A window unit according to claim 16, wherein said strip of sealing material is a pre-shimmed butyl tape strip, and said strip of caulking is made of water-impervious urethane rubber.

18. A window unit according to claim 15, wherein said outer encasing frame has an inner flange formed on the inside of the side face thereof disposed below said insulated glass insert, projecting orthogonally therefrom and disposed adjacent to the side faces of said inner supporting frame in position to abut thereagainst to provide resistance against forces acting upon said window unit.

19. A window unit according to claim 15, wherein said outer encasing frame has a outwardly extending free edge about its periphery, so as to divert water and other natural elements away from said window unit and to strengthen said outer encasing frame against forces imposed thereon.

20. A window unit according to claim 15, wherein flashing means is mounted in the area of joinder between said liner and said roof structure.

21. A window unit according to claim 15, wherein said insulated glass insert comprises;

an inner panel made of laminated glass;

an outer panel made of tempered glass; and a panel spacer frame having a hollow substantially rectangular cross-section.

22. A window unit according to claim 21, wherein said panel spacer frame is interposed between said inner panel and said outer panel and positioned equidistant from the perimeters of said panels, thereby forming about periphery of said glass insert, an open channel-like cavity between the intersection thereof, said open channel-like cavity being filled with an adhesive material for bonding said inner panel, said outer panel, and said panel spacer frame securely together, and a sealing material applied upon said adhesive material so as to prevent water and other natural elements from establishing contact with said adhesive material.

23. A window unit according to claim 22, wherein said adhesive material is a butyl rubber, and said sealing material is a water-impervious silicone.

24. A window unit according to claim 15, wherein said window unit is rectangular in configuration.

25. A window unit according to claim 15, wherein said window unit is square in configuration.

26. A window unit adapted to mounted on a liner of a skylight assembly, to cover an opening in a roof structure, comprising:

an insulated glass insert of a predetermined size and shape to substantially conform to an opening in a roof structure;

an inner supporting frame adapted to engage and seat on a liner and to support said glass insert;

an outer encasing frame adapted to be coupled to said inner supporting frame and capture said glass insert therebetween, said inner supporting frame and said outer encasing frame being located adjacent said wall of said liner and engaging the peripheral portion of said glass insert so as to expose a maximum of said glass insert overlying the opening in said roof structure while maintaining minimum exterior dimensions for said window unit;

a first means for sealing positioned between said glass insert and said outer frame to provide insulation and prevent a direct contact therebetween;

a second means for sealing positioned between the engaging surfaces of said inner supporting frame and said liner so as to seal said engaging surfaces therebetween when said window unit is positioned on said liner, and said first means for sealing including a gasket interposed between said glass insert and said inner supporting frame and a sealant system including a strip of sealing material disposed along the primeter of said glass insert and a strip of caulking disposed on said glass insert adjacent to said strip of sealing material, on the side thereof nearest to the center of said glass insert, said sealant system interposed between said outer encasing frame and said insulated glass insert, said gasket has having a slot formed therein adapted to receive and seal the peripheral edge of said inner supporting frame and has having an outer orthogonally-projecting edge in position to cooperate in properly seating said glass insert and to prevent direct contact of said glass insert with said inner supporting frame and said outer encasing frame.

27. A window unit according to claim 26, wherein said outer othrogonally-projecting edge of said gasket has at least one aperture therein, so as to provide a means for escaping entrapped water from said window unit.

28. An insulated skylight assembly according to claim 27, wherein said aperture formed in said outer orthogonally-projecting edge is located at a side of said window unit wheretowards rain water and natural elements flow in response to gravitational forces when said window unit is positioned said liner.

29. An insulated glass skylight assembly adapted to be mounted to cover an opening in a roof structure, comprising:

a box-like liner adapted to be mounted adjacent the edge of an opening in a roof structure around the periphery thereof, to surround said opening and to form a wall extending upward from said roof structure; and a swinging window unit including, an insulated glass insert of a predetermined size and shape to substantially conform to said opening in said roof structure;

an inner liner supporting frame adapted to engage and seat on said liner and to support said glass insert;

an outer encasing frame adapted to be coupled to said inner supporting frame and capture said glass insert therebetween, said inner and outer frames being located adjacent said wall of said liner and engaging the peripheral portion of said glass insert;

a means for sealing positioned between said glass insert and said outer frame to provide insulation and prevent a direct contact therebetween;

a unitary sealing means positioned between the engaging surfaces of said inner supporting frame and said liner and between the engaging surfaces of said glass insert and said inner supporting frame so as to seal said engaging surfaces therebetween when said swinging window unit is positioned on said liner; and means for pivotably interconnecting said swinging window unit to said liner so as to permit shifting of said swinging window unit with respect to said liner between a closed position overlying said opening in said roof structure and in sealing engagement therewith, and an open position permitting access to said opening from the exterior of said roof structure.

30. An insulated glass skylight assembly adapted to be mounted to cover an opening in a roof structure, comprising:

a box-like liner adapted to be mounted adjacent the edge of an opening in a roof structure areound the periphery thereof, to surround said opening and to form a wall extending upward from said roof structure; and a swinging window unit including, an insulated glass insert of a predetermined size and shape to substantially conform to said opening in said roof structure;

an inner supporting frame adapted to engage and seat on said liner and to support said glass insert;

an outer encasing frame adapted to be coupled to said inner supporting frame and capture said glass insert therebetween, said inner and outer frames being located adjacent said wall of said liner and engaging the peripheral portion of said glass insert;

a means for sealing positioned between said glass insert and said outer frame to provide insulation and prevent a direct contact therebetween;

a unitary sealing means positioned between the engaging surfaces of said inner supporting frame and said liner and between the engaging surfaces of said glass insert and said inner supporting frame so as to seal said engaging surfaces therebetween when said window unit is positioned on said liner.

* * * * *

UNITED STATES PATENT AND TRADEMARK OFFICE

CERTIFICATE OF CORRECTION

PATENT NO. : 4,750,302

DATED : June 14, 1988

INVENTOR(S) : Stephen K. Bechtold

It is certified that error appears in the above-identified patent and that said Letters Patent is hereby corrected as shown below:

Col. 10, line 15, after "glass", change "inset" to --insert--

Col. 10, line 18, after "glass", change "inset" to --insert--

Col. 11, line 8, after "structure", change "areound" to --around--

Col. 11, line 44, before "of", change "primeter" to --perimeter--

Col. 12, line 25, after "seal", insert --said--

Col. 13, line 14, after "to", insert --be--

Col. 13, line 28, after "maximum", insert --amount--

Col. 13, line 33, after "said", insert --inner and--

UNITED STATES PATENT AND TRADEMARK OFFICE

CERTIFICATE OF CORRECTION

PATENT NO. : 4,750,302

DATED : June 14, 1988

INVENTOR(S) : Stephen K. Bechtold

It is certified that error appears in the above-identified patent and that said Letters Patent is hereby corrected as shown below:

Col. 13, line 67, after "positioned", insert --on--

Col. 14, line 43, after "structure", change "areound" to --around--

Col. 14, line 47, before "window", delete "swinging".

Signed and Sealed this

Twenty-fifth Day of April, 1989

*Attest:*

*Attesting Officer*

DONALD J. QUIGG

*Commissioner of Patents and Trademarks*